US011085603B2

(12) United States Patent
Gousset-Rousseau

(10) Patent No.: US 11,085,603 B2
(45) Date of Patent: Aug. 10, 2021

(54) MOTOR VEHICLE HEADLIGHT MODULE FOR EMITTING A LIGHT BEAM

(71) Applicant: VALEO VISION, Bobigny (FR)

(72) Inventor: Simon Gousset-Rousseau, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/866,042

(22) Filed: May 4, 2020

(65) Prior Publication Data

US 2020/0263848 A1 Aug. 20, 2020

Related U.S. Application Data

(63) Continuation of application No. 15/483,470, filed on Apr. 10, 2017, now Pat. No. 10,663,134.

(30) Foreign Application Priority Data

Apr. 11, 2016 (FR) ..... 16 53166

(51) Int. Cl.

| | |
|---|---|
| ***F21S 41/26*** | (2018.01) |
| ***F21S 41/143*** | (2018.01) |
| ***F21S 41/20*** | (2018.01) |
| ***F21S 41/32*** | (2018.01) |
| ***F21S 41/43*** | (2018.01) |
| ***F21S 41/60*** | (2018.01) |
| ***F21S 41/663*** | (2018.01) |
| ***F21S 41/153*** | (2018.01) |
| ***F21S 41/147*** | (2018.01) |

(52) U.S. Cl.

CPC ..... *F21S 41/26* (2018.01); *F21S 41/143* (2018.01); *F21S 41/147* (2018.01); *F21S 41/153* (2018.01); *F21S 41/285* (2018.01); *F21S 41/322* (2018.01); *F21S 41/43* (2018.01); *F21S 41/60* (2018.01); *F21S 41/663* (2018.01)

(58) Field of Classification Search

None

See application file for complete search history.

(56) References Cited

U.S. PATENT DOCUMENTS

2005/0068787 A1 3/2005 Ishida
2014/0321141 A1 10/2014 Bauer et al.

FOREIGN PATENT DOCUMENTS

AU 512 246 A1 6/2013
CN 10432859 8/2015
CN 105371204 A 3/2016

(Continued)

OTHER PUBLICATIONS

French Preliminary Search Report dated Jan. 20, 2017 in French Application 16 53166 filed on Apr. 11, 2016 (with English Translation of Categories of Cited Documents).

(Continued)

*Primary Examiner* — Britt D Hanley

(74) *Attorney, Agent, or Firm* — Oblon, McClelland, Maier & Neustadt, L.L.P.

(57) ABSTRACT

Module for a motor vehicle for emitting at least one light beam with a cut-off profile along an optical axis, the module including first and second optical collectors adapted to collect light emitted by respective first and second light sources and to redirect said light toward a focal region, at least one of said collectors extending in the direction of said focal region in order to reflect some of the light emitted by the other collector so as to define said cut-off profile.

11 Claims, 6 Drawing Sheets

(56) References Cited

FOREIGN PATENT DOCUMENTS

| | | | |
|---|---|---|---|
| CN | 104832859 | B | 8/2018 |
| DE | 10 2007 052 696 | A1 | 7/2008 |
| EP | 2 711 611 | A1 | 3/2014 |
| FR | 2 860 280 | A1 | 4/2005 |
| JP | 2015-501513 | A | 1/2015 |
| JP | 2015-185533 | A | 10/2015 |
| JP | 2016-039110 | A | 3/2016 |

OTHER PUBLICATIONS

Office Action dated Apr. 1, 2021 in Chinese Patent Application No. 201710230914.0 with English translation, citing reference AO, 13 pages.

MOTOR VEHICLE HEADLIGHT MODULE FOR EMITTING A LIGHT BEAM

CROSS REFERENCE TO RELATED APPLICATIONS

This application is a continuation of U.S. application Ser. No. 15/483,470, filed Apr. 10, 2017, which is based upon and claims the benefit of priority of French Patent Application No. 16 53166 filed on Apr. 11, 2016, the entire content of each of which is hereby incorporated by reference.

The present invention relates to a device for emitting a light beam. A preferred application concerns the automotive industry and the production of lighting devices, notably motor vehicle headlights.

In that field there are known lighting modules conventionally including low beam function having a range on the road approximating 70 meters that are used essentially at night and the configuration of the light beam of which is such that it prevents dazzling the driver of a vehicle traveling in the opposite direction or that is being followed. This beam typically has a cut-off in the upper part with a horizontal portion, preferably at approximately 0.57 degrees below the horizon, in order not to illuminate the area in which the driver of an oncoming vehicle would be located.

The publication FR2934667 is situated this technology by virtue of forming a lighting module that produces a beam with a cut-off by means of a folder disposed along the optical axis between respective first and second optical collectors adapted to collect light emitted by first and second light sources and to redirect the light toward a focal region in which one of the ends of the folder is situated. Downstream of the folder the rays are projected via a projection lens situated at the exit of the lighting module.

The above prior art has a relatively complex structure, notably because of a large number of components to be assembled to form the headlight. Moreover, the folder disposed between the two collectors has the effect of generating a dark line in the light beam when the first and second light sources are lit for a "full beam" (high beam) function.

The invention makes it possible to solve some or all of the drawbacks of the current techniques and to this end proposes to implement the cut-off function by exploiting the phenomenon of reflection, preferably total reflection, at one of the collectors so as to dispense with the folder. In the following description, by "collector adapter to reflect a light ray by total reflection" is meant a collector made from a material with a refractive index such that a light ray arriving at a wall of the collector with an angle of incidence greater than a predetermined value is totally reflected at that wall without any significant portion of the energy of that ray being transmitted through said wall.

In this sense, the invention concerns a module for a motor vehicle for emitting at least one light beam with a cut-off profile along an optical axis, the module including at least one first light source and at least one second light source and at least one first optical collector and at least one optical second collector respectively adapted to collect light emitted by said at least one first light source and said at least one second light source and to redirect said light toward a focal region.

According to the invention one of said at least one first collector and/or at least one second collector is advantageously used as an optical reflector to generate a beam with a cut-off profile without necessitating any additional component such as a metal plate fixed between said first and second collectors. Said collector serving as the cut-off element makes it possible to reflect some or all of the rays coming from the other collector or collectors toward an upper/lower edge of the lens, possibly adapted to project the beam.

According to various embodiments envisaged, the reflection may be achieved either by vitreous reflection at a diopter surface defined between the collector and the surrounding medium or by metal reflection at a metal coating deposited on a part of the surface of the collector. In both cases the external surface of one collector relative to the other serves as the optical reflector.

At least one of said collectors advantageously extends in the direction of the focal region in order to reflect some of the light emitted by the other collector so as to define the cut-off profile.

Other optional and nonlimiting features are recited hereinafter. They may be employed separately or in any combination with one another:

- at least one of the collectors extending in the direction of the focal region is adapted to produce the cut-off of said at least one beam by external reflection, notably partial and/or vitreous reflection, of at least some of said light emitted by the other collector,
- at least one of the collectors extending in the direction of the focal region is adapted to produce the cut-off of said at least one beam by total reflection of at least some of said light emitted by the other collector,
- said at least one first collector and said at least one second collector are separate components,
- said at least one first collector and said at least one second collector are separated by a medium having a refractive index lower than the refractive index of the collectors,
- the medium is air,
- the collector or collectors extending in the direction of the focal region has or have an exit face in said focal region,
- said exit face in said focal region is convex, concave or inclined,
- only one of the collectors extends toward the focal region,
- said at least one of said collectors extending in the direction of the focal region includes a surface for reflecting light emitted by said other collector,
- the collector extending toward the focal region includes a reflective coating on a part of the collector and intended to reflect some or all of the rays coming from the other collector,
- the coating is on at least a part of the surface of the collector extending from the focal region in the direction of the light sources,
- said at least one first collector and said at least one second collector extend along the optical axis in the direction of the focal region,
- the collector or collectors extending in the direction of the focal region includes or include a collection region having an axis of symmetry inclined in the direction of the optical axis of the module,
- the collector or collectors extending in the direction of the focal region include a surface tangential to the optical axis of the module,
- at least one of said at least one first collector and said at least one second collector comprises polycarbonate,
- the refractive indices of the first and second collectors are identical.

said at least one first light source and said at least one second light source are oriented so as to emit light in directions substantially parallel to the optical axis of the module, at least one of the light sources is oriented so as to emit light in the direction of the optical axis, at least one of said at least one first light source and said at least one second light source includes a light-emitting diode, the module is such that some of the light passing through one of the collectors and coming from the associated light source or sources passes through the other collector so as to exit via the exit face in the focal region, the module includes a plurality of first collectors and/or a plurality of second collectors, said plurality of said first collectors are in one piece with one another and/or the plurality of second collectors are in one piece with one another, the module further includes a projection lens that can be configured to be common to the plurality of first collectors and/or to the plurality of second collectors.

Another aspect of the invention relates to an emitter device including at least one emitter module having any one or more of the features described above. According to one particular feature of the invention, the device is a motor vehicle front headlight.

Other features, objects and advantages of the present invention will become apparent on reading the following detailed description referring to the appended drawings provided by way of nonlimiting example and in which.

Figure 1:
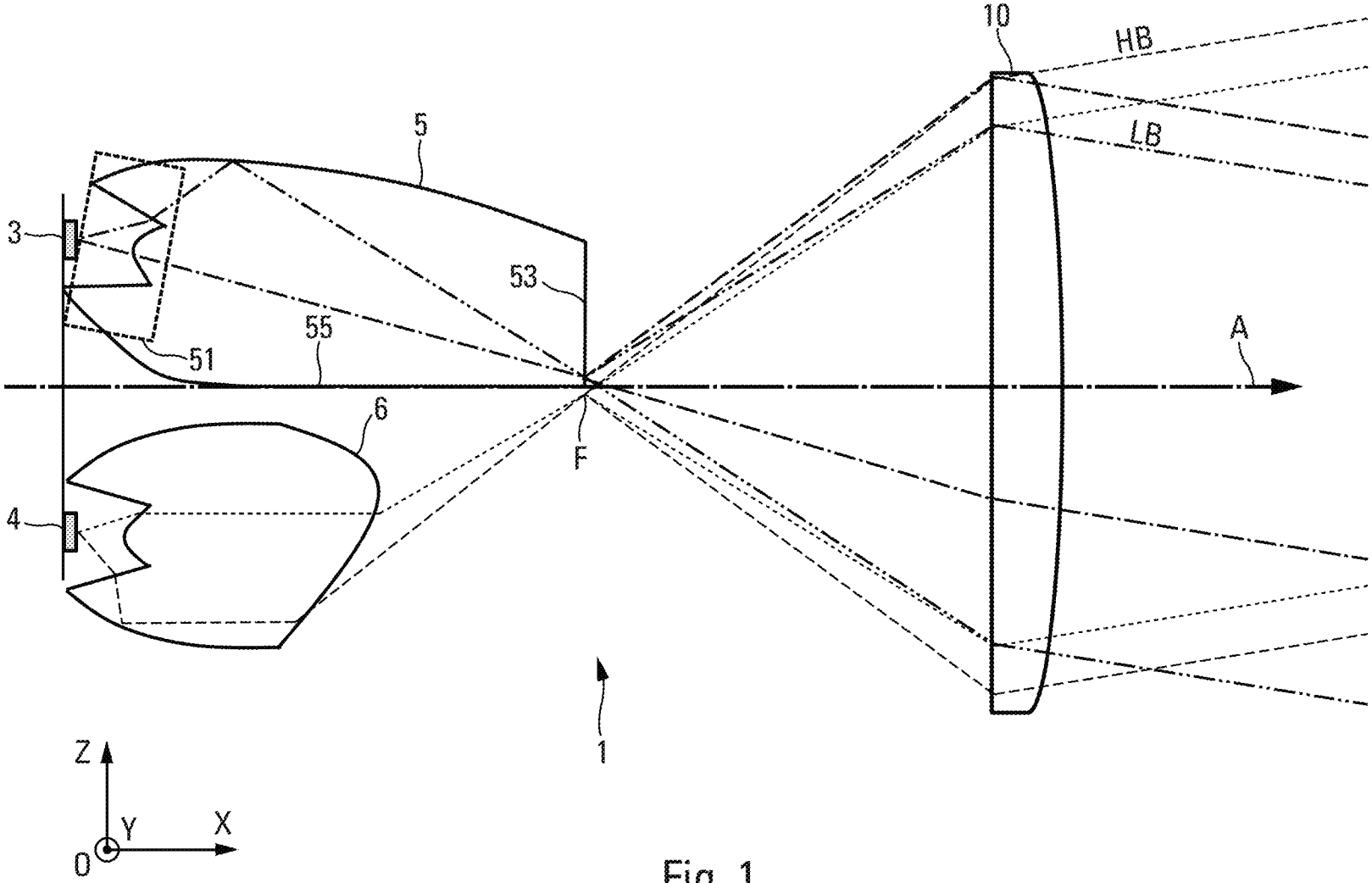
FIG. 1 shows a first embodiment of the invention in section on a vertical plane passing through the optical axis.

FIG. 1 is a representation in section of a lighting module 1 according to one embodiment of the invention for motor vehicles. In this representation, the section is on a vertical plane [O, X, Z] of a local frame of reference {O, X, Y, Z}, in which the axis O-X indicates a horizontal direction parallel to the optical axis of the headlight and the axis O-Z designates a vertical direction perpendicular to the axis O-X.

The lighting module shown in FIG. 1 is intended to produce two light beams for the implementation of two distinct lighting functions: (i) illumination having a cut-off profile to prevent dazzling vehicles traveling in the opposite direction (corresponding to a lighting function of "low beam" type), and (ii) illumination with no cut-off profile (corresponding to a lighting function of "full beam" or "high beam" type).

The lighting module (or emitter module) 1 according to the invention includes a first assembly consisting of a first light source 3 and a first optical collector 5, the first optical assembly being intended to supply a first light beam.

The module 1 according to the invention further includes a second assembly consisting of a second light source 4 and a second optical collector 6, the second optical assembly being intended to supply a second light beam.

A convergent lens 10 is disposed along the optical axis A so as to project the optical beams from the collectors and to produce one of the two lighting functions by lighting one or both light sources 3, 4.

According to the invention, the first collector 5 extends in the direction of a focal region to reflect some of the light emitted by the other collector so as to define the cut-off profile. Here the focal region corresponds to the focus F of the lens 10.

The first collector 5 advantageously has a surface 55 for reflecting light coming from the second collector 6. To be more precise, the cut-off profile of the beam is produced by a surface element 55 of the first collector 5 at the level of the focus F, that surface element forming a diopter between the first collector 5 and the surrounding medium consisting of air. The cut-off is produced by partial external reflection of vitreous reflection type. A cut-off in the beam can therefore and advantageously be produced without necessitating any additional component, such as a metal plate termed a folder.

The cut-offs produced can have any orientation in space. The cut-off profile preferably results from the formation of an exit beam that is not uniformly distributed around the optical axis because of the presence of an area of less exposure to light, that area being substantially delimited by a cut-off profile that can be formed by at least two and notably three straight line segments at an angle to one another to form a kink. The resulting lighting is referred to as of "low beam" type.

In the present example, each light source 3, 4 consists of a light-emitting diode. However, in other embodiments a plurality of emitter elements can be combined to form each of the first and second light sources so as to emit a luminous flux of higher optical power at the exit of the projection lens. Each emitter element can consist of a light-emitting diode or a laser diode, for example.

According to another particular feature of the invention, the first light source 3 and the second light source 4 are oriented so as to emit light in directions parallel to the optical axis A of the module The first collector 5 and the second collector 6 are adapted to collect the light emitted by the first light source 3 and the second light source 4, respectively, and to redirect the collected light toward the focal region and in particular toward the focal point F.

According to one particular feature of the invention, the first collector 5 extending in the direction of the focal region includes a collection region 51 having an axis of symmetry inclined in the direction of the optical A of the module.

According to another particular feature of the invention, the first and second collectors are separated by a medium having a refractive index lower that the refractive index of the collectors. In the present example, that medium is air.

As already indicated, a diopter surface 55 is therefore formed between the air and the first collector 5. As a result, some or all of the rays from the second collector 6 are reflected at the surface of the first collector 5, for example, by vitreous reflection.

According to another particular feature of the invention, the first collector 5 extending in the direction of the focal region has an exit face 53 in the focal region and more particularly in a vertical plane (F, 0, Y) containing the focal point F. The diopter surface 55 of the first collector 5 is tangential to the optical axis A of the module.

The first and second collectors are made of a transparent material having a refractive index higher than the refractive index of air. Polycarbonate (PC) able to withstand the heat generated by the diodes (LED) is preferably used. The choice of this material is particularly advantageous in that the diodes (LED) are in the vicinity of the transparent collectors.

In other embodiments, the collectors could be made of polypropylene carbonate (PPC) or polymethylmethacrylate (PMMA).

Figure 2:
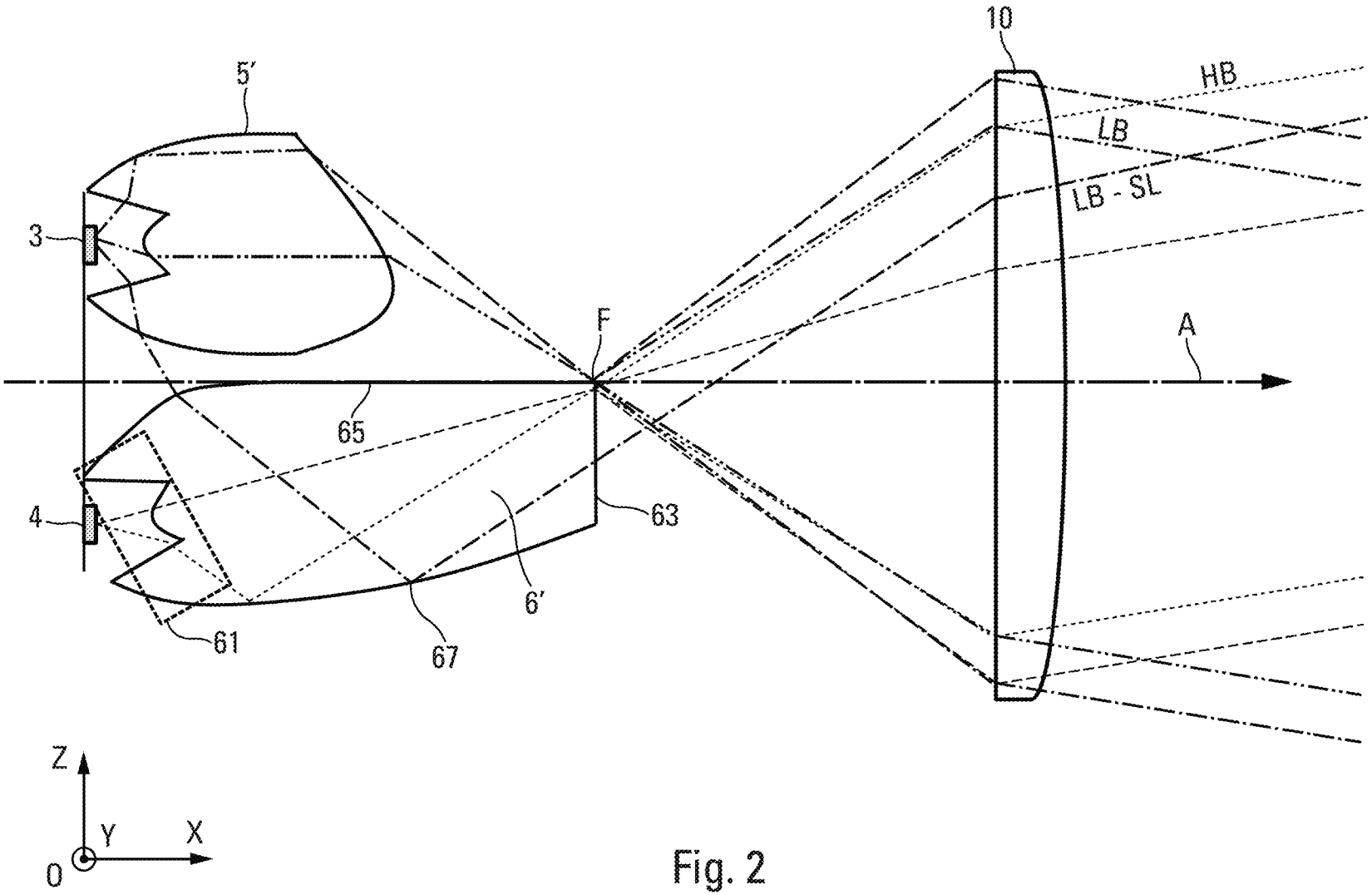
FIG. 2 shows a second embodiment of the invention in section on a vertical plane passing through the optical axis.

FIG. 2 shows a second embodiment of the invention in section on a vertical plane (O, X, Z) passing through the optical axis A. This second embodiment differs from the first embodiment described with reference to FIG. 1 in that the second collector 6' extends along the optical axis A in the direction of the focal region.

According to one particular feature of the invention, the second collector 6' extending in the direction of the focal region includes a collection region 61 having an axis of symmetry inclined in the direction of the optical axis A of the module.

A diopter surface 65 is formed between the ambient medium consisting of air and the second collector 6' enabling some or all of the rays from the first collector 5' to be reflected at the surface of the second collector 6' by partial external reflection of vitreous reflection type. The cut-off profile of the beam is produced by an element of the diopter surface 65 at the level of the focus F, as described above with reference to FIG. 1. According to another particular feature of the invention, the module is such that some of the light from the first light source 3 associated with the first collector 5' is transmitted by said first collector 5' and passes through the second collector 6' so as to exit via the exit face 63 in the focal region.

The first light source 3 and/or the first collector 5' are such that some of the light from that source passes through the first collector 5' and enters the second collector 6'. Various adaptations may be envisaged for achieving this:

a) the first light source 3 is slightly inclined in the direction of the optical axis A; and/or
b) the first light source 3 emits with a sufficiently wide emission angle in the direction of the second collector 6'; and/or
c) the collection zone of the first collector 5' is such that some of the rays emitted by the first source 3 are not reflected at the surface of the first collector 5' so that those rays are injected into the second collector 6'.

The second collector 6' is adapted to guide the injected light coming from the first collector 5' to the exit surface 63 of the second collector 6' so as to reach the projection lens 10. To this end, the lower surface 67 of the second collector 6' is conformed so that the light from the first collector 5' undergoes total reflection at this surface. The light emitted in this way can serve to illuminate high signaling panels situated above the carriageway.

The lower surface 67 of the second collector 6' is conformed to illuminate the signaling panels, whether by partial or total reflection, or by metallizing this surface.

Figure 3:
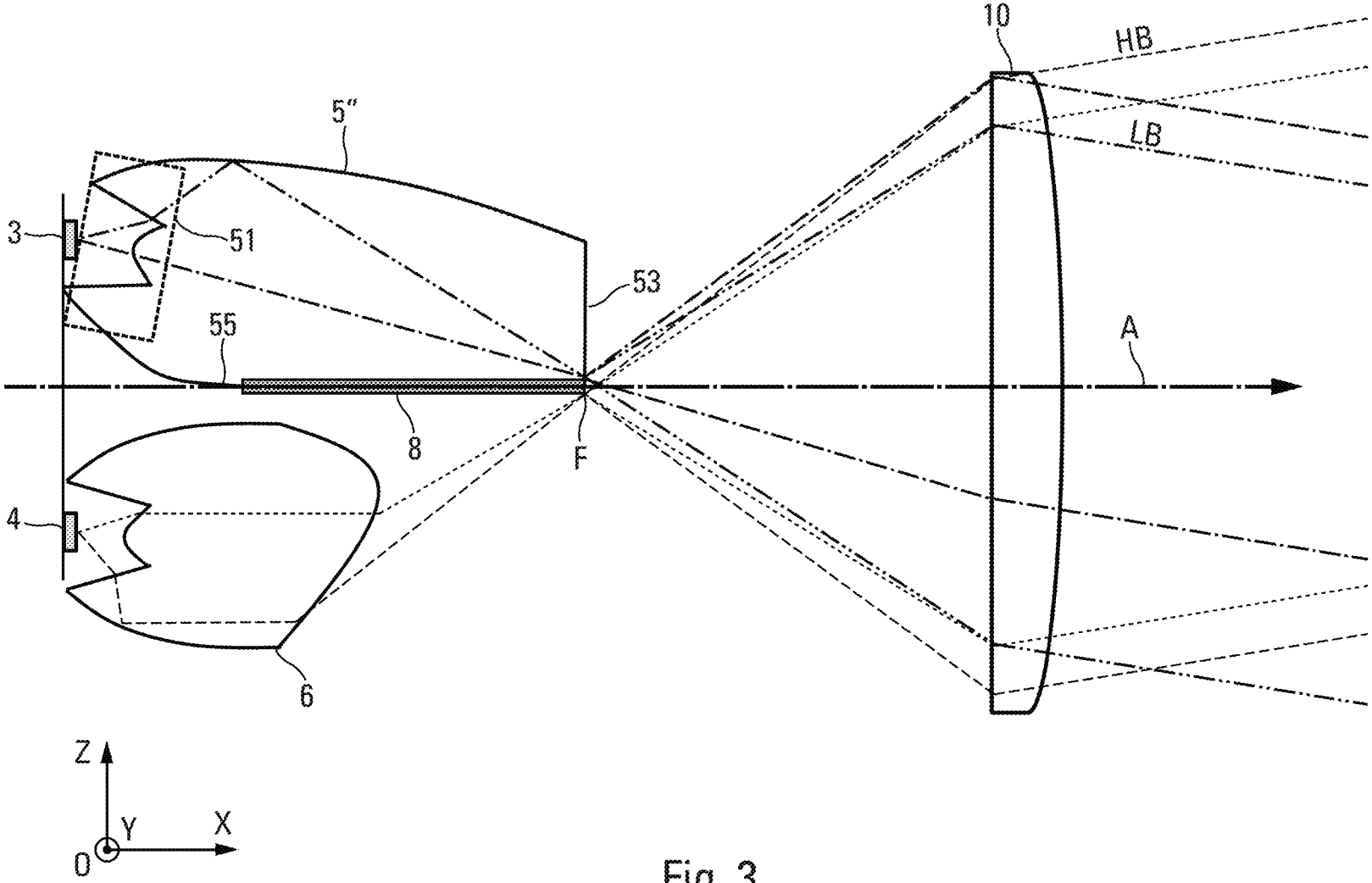
FIG. 3 shows a variant of a first embodiment of the invention in section on a vertical plane passing through the optical axis.

FIG. 3 shows in section on a vertical plane (O, Y, Z) passing through the optical axis A a variant applied to the first embodiment of the invention described above with reference to FIG. 1.

According to this variant embodiment, the first collector 5" extending toward the focal region includes a reflective coating 8 disposed on a portion of the collector 5", notably at the level of the focal region, so as to reflect some or all of the rays coming from the other collector 6 in accordance with a cut-off profile. By way of illustrative and nonlimiting example, this reflective coating 8 consists of a thin layer of metal, the layer being thin enough to avoid the appearance of an area of absence of light at the exit of the projection lens 10. This metal coating moreover makes it possible to improve the emission efficiency of the portion of the module that does not extend as far as the focal region (i.e. the second source 4 and the second collector 6 in the FIG. 3 example), by virtue of the high reflection power of metal compared to vitreous reflection. Moreover, a coating of this kind can easily be conformed according to the required cut-off profile. It therefore constitutes a cut-off element integrated into the first collector 5" of the module.

According to this variant embodiment, the metal coating 8 covers part of the surface 55 of the first collector 5 tangential to the optical axis A so that some or all of the rays coming from the second collector 6 are reflected at the metal coating 8 (external reflection of metal reflection type) so as to be redirected toward a lower edge of the lens 10.

Figure 4:
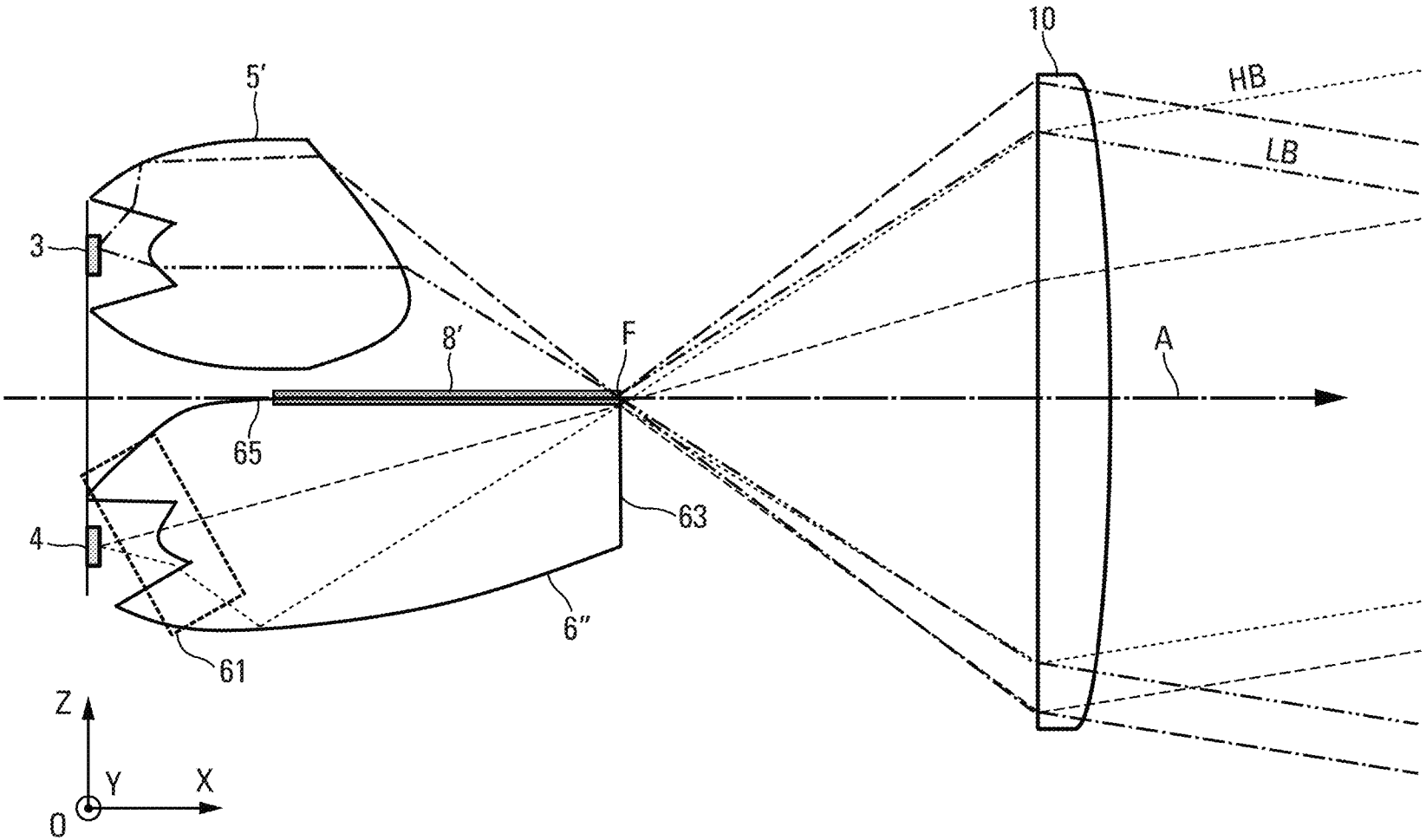
FIG. 4 shows a variant of a second embodiment of the invention in section on a vertical plane passing through the optical axis.

FIG. 4 shows in section on a vertical plane (0, Y, Z) passing through the optical axis A the same variant embodiment applied to the second embodiment of the invention described above with reference to FIG. 2.

According to this same variant embodiment, the metal coating 8' covers part of the surface 65 of the second collector 6" tangential to the optical axis A so that some or all of the rays coming from the first collector 5' are reflected at the metal layer 8' so as to be redirected toward an upper edge of the lens 10.

The cut-off of the beam is therefore produced by means of reflection by a metal in the form of the metal coating 8' of the rays coming from the first collector 5'.

Figure 5:
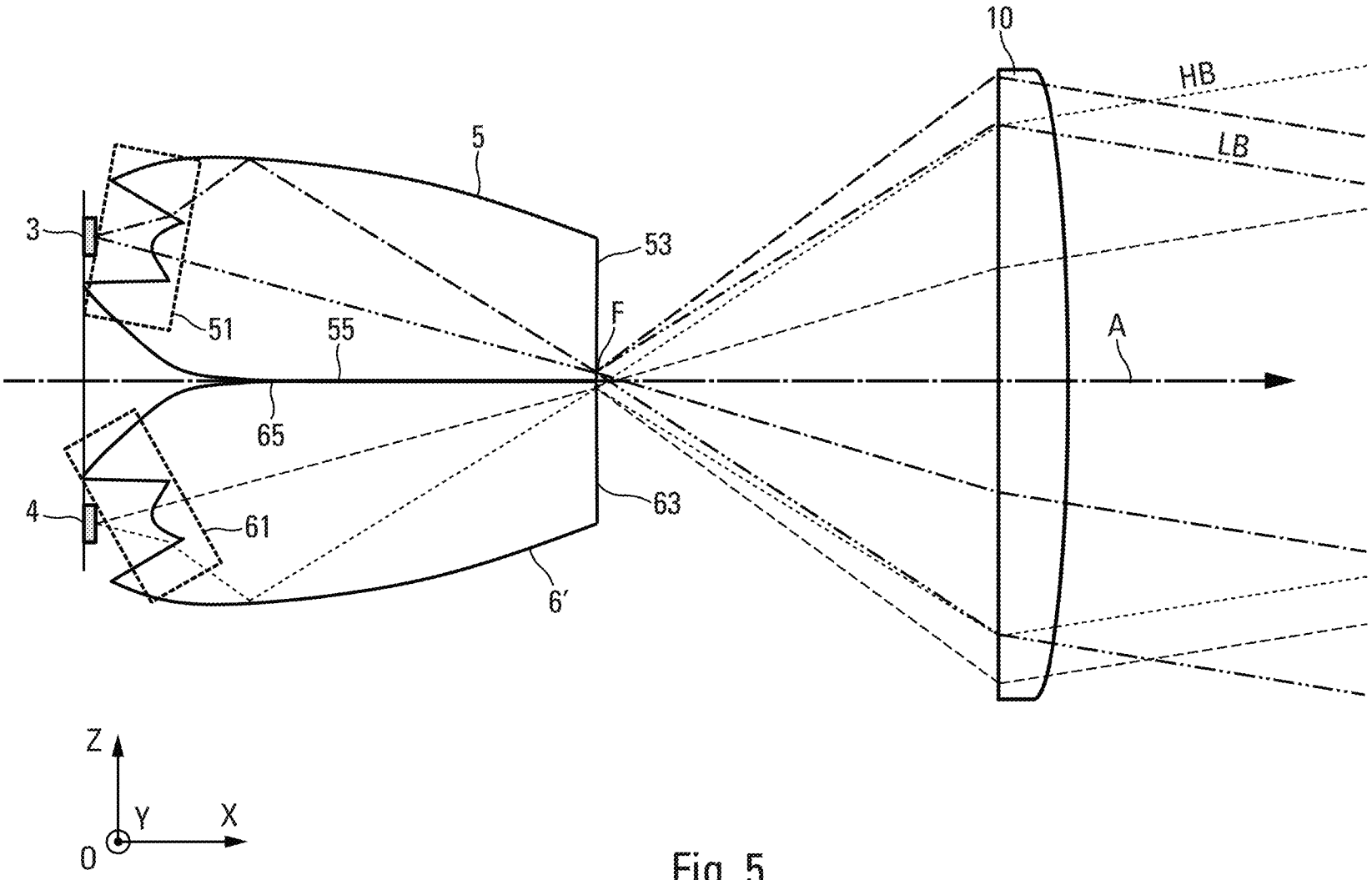
FIG. 5 shows a third embodiment of the invention in section on a vertical plane passing through the optical axis.

FIG. 5 shows in section on a vertical plane (O, Y, Z) passing through the optical axis A a third embodiment of the invention in which the first collector 5 and the second collector 6' extend in the direction of the focal region and in particular toward the focal point F of the lens 10.

According to one particular feature of the invention, each of the two collectors 5, 6' has an exit face 53, 63 in the focal region and in particular in a vertical plane (F, Y, Z) containing the focal point F of the lens 10.

As shown in FIG. 5, the lower surface 55 of the first collector 5 and the upper surface 65 of the second collector 6' meet on the optical axis A so that the two collectors are in contact with each other to form a diopter surface.

The cut-off is therefore produced by total reflection at the level of the diopter surface.

This embodiment, in which the first and second collectors both extend as far as the focal point F of the lens 10, advantageously makes it possible to maximize the respective optical fluxes coming from the first collector 5 and the second collector 6', given that each of these fluxes undergoes total reflection at the level of the diopter surface.

According to another particular feature of the invention, employed in particular in the situation where the two collectors have the same refractive index, the two collectors are separated by a thin layer of air disposed along the optical axis A so that each collector defines a diopter surface with air.

Each diopter surface formed by a collector in this way makes it possible to reflect some or all of the light emitted by the other collector. Some or all of the rays from the two collectors are therefore reflected toward the upper and lower edges of the lens 10.

In the embodiments described with reference to FIGS. 1 to 6, the exit face of the collector or collectors extending in the direction of the focal region has a plane surface perpendicular to the optical axis A. This is the exit face 53 of the first collector 5, 5" as shown in FIGS. 1, 3, 5 and the exit face 63 of the second collector 6', 6" as shown in FIGS. 2, 4, 5.

In other embodiments of the invention, this exit face could have a convex or concave surface and/or be inclined relative to the optical axis in order to widen or to concentrate the optical beam and/or to correct any aberrations of the projection lens 10.

The edge formed by the intersection of the exit surface of the transparent collector having been extended in the direction of the optical axis and the lower surface of that collector forming the cut-off element can be conformed so as to reduce the effect of aberrations of the projection lens 10 on the shape of the cut-off in the beam. This is the edge of the first collector 5, 5' between its exit surface 53 and its lower surface 55 as shown in FIGS. 1, 3 or the edge of the second collector 6', 6" between its exit surface 63 and its lower surface 65 as shown in FIGS. 2, 4.

Figure 6:
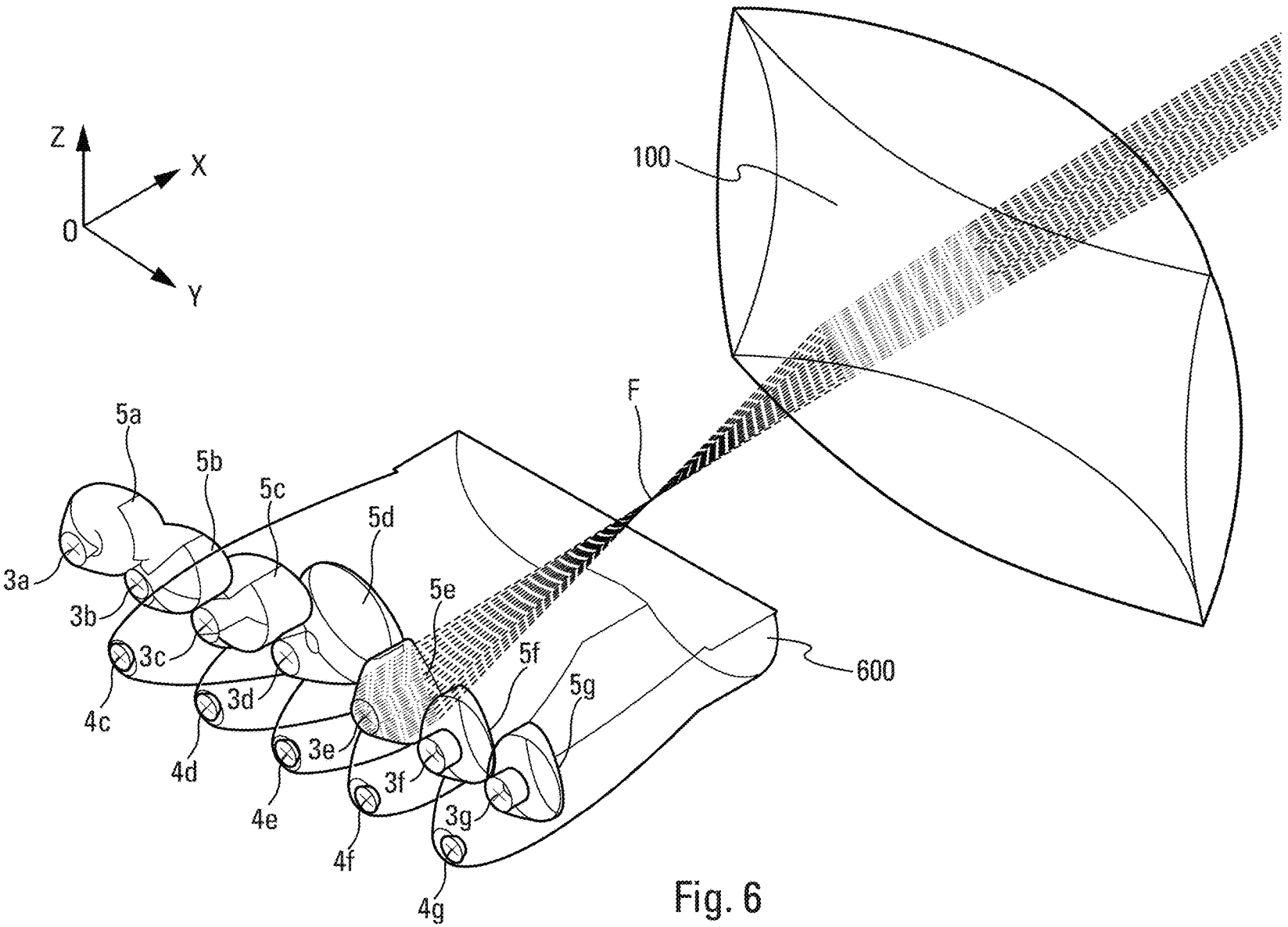
FIG. 6 shows in perspective a multi-source lighting module according to the invention.

FIG. 6 shows in perspective a multi-source module according to the invention including a plurality of emitter modules according to the second embodiment described above with reference to FIG. 2.

The module is termed "multi-source" in the sense that it includes a plurality of light sources to obtain sufficient optical power according to the lighting standards in force. In particular, the module includes a first row of seven light-emitting diodes 3*a*, 3*b*, 3*c*, 3*d*, 3*e*, 3*f*, 3*g* (first sources) and a second row of five light-emitting diodes 4*c*, 4*d*, 4*e*, 4*f*, 4*g* (second sources). Seven first collectors and five second collectors are respectively associated with the seven first light sources and the five second light sources.

According to one particular feature of the invention, the second collectors are in one piece with one another so as to form a single component 600, said component being easily manufacturable by molding or by any other appropriate fabrication technique. In other embodiments the first collectors are in one piece with one another so as to form a single component.

The module further includes a projection lens 100 common to all of the sources and collectors.

The invention claimed is:

1. A module for a motor vehicle for emitting at least one light beam with a cut-off profile along an optical axis, the module including a first light source and a second light source, and a first optical collector and a second optical collector respectively collecting light emitted by the first light source and the second light source and redirecting the light toward a focus of a lens disposed along the optical axis, wherein the model projecting light emitted by the first optical collector and the second optical collector, wherein at least one of the first and second optical collectors extends in the direction of the focus in order to reflect some of the light emitted by the other of the first and second optical collectors so as to define the cut-off profile, wherein the at least one of the first and second optical collectors extending in the direction of focus produces the cut-off profile of the at least one beam and at least some of the light emitted by the other of the first and second optical collectors enters the at least one of the first and second optical collectors and undergoes total internal reflection inside therein, and wherein the at least one of the first and second optical collectors extending in the direction of the focus has an exit face at the focus.

2. The module according to claim 1, wherein the first and second optical collectors are separated by a medium having a refractive index lower than the refractive index of the first and second optical collectorsr.

3. The module according to claim 2, wherein some of the light passing through the at least one of the first and second optical collectors from the associated light source passes through the other of the first and second optical collectors so as to emerge via the exit face in the focal region.

4. The module according to claim 3, wherein only one of the first and second optical collectors extends toward the focus.

5. The module according to claim 4, wherein the at least one of the first and second optical collectors extending toward the focus includes a reflective coating on a part thereof to reflect some or all of the rays coming from the other of the first and second optical collectors.

6. The module according to claim 5, wherein the coating is on at least a part of the surface of the at least one of the first and second optical collectors and extends from the focus in the direction toward the first and second optical sources.

7. The module according to claim 3, wherein the at least one of the first and second optical collectors extends along the optical axis in the direction of the focus.

8. The module according to claim 1, wherein the at least one of the first and second optical collectors extending in the direction of the focus includes a collection region having an axis of symmetry inclined with respect to the optical axis of the module.

9. The module according to claim 1, wherein the at least one of the first and second optical collectors extending in the direction of the focus includes a surface tangential to the optical axis of the module.

10. The module according claim 1, wherein the at least one first and second light sources is oriented so as to emit light in directions substantially parallel to the optical axis of the module.

11. The module according to claim 1, wherein at least one of the first and second optical collectors comprises a plurality of optical collectors integrated into one piece.

* * * * *